US009732639B1

(12) United States Patent
Dike

(10) Patent No.: US 9,732,639 B1
(45) Date of Patent: Aug. 15, 2017

(54) VARIABLE LIFT VALVE TRAIN

(71) Applicant: Anthony Dike, Ben Wheeler, TX (US)

(72) Inventor: Anthony Dike, Ben Wheeler, TX (US)

( * ) Notice: Subject to any disclaimer, the term of this patent is extended or adjusted under 35 U.S.C. 154(b) by 83 days.

(21) Appl. No.: 14/887,828

(22) Filed: Oct. 20, 2015

(51) Int. Cl.
*F01L 1/18* (2006.01)
*F01L 1/344* (2006.01)
*F01L 1/047* (2006.01)

(52) U.S. Cl.
CPC ..... *F01L 1/344* (2013.01); *F01L 1/047* (2013.01); *F01L 1/18* (2013.01); *F01L 1/181* (2013.01)

(58) Field of Classification Search
CPC ..... F01L 1/18; F01L 1/181
USPC ..... 123/90.39, 90.44, 90.16
See application file for complete search history.

(56) References Cited

U.S. PATENT DOCUMENTS 4,408,580 A 10/1983 Kosuda
4,502,426 A 3/1985 Skelley
4,640,238 A 2/1987 Camosso
5,572,963 A 11/1996 Kawasaki
5,857,438 A 1/1999 Barnard
6,619,251 B2 9/2003 Kobayashi
7,077,088 B1 * 7/2006 Decuir, Jr. ..... F01L 1/024 123/90.24
D528,564 S 9/2006 Tomiji
8,763,572 B1 * 7/2014 Dike ..... F01L 1/182 123/90.16

* cited by examiner

*Primary Examiner* — Ching Chang
(74) *Attorney, Agent, or Firm* — Kyle A. Fletcher, Esq.

(57) ABSTRACT

The variable lift valve train includes a spring-loaded valve that is in mechanical connection with a lever bar. The lever bar is attached to a stroke limiter. The lever bar extends across the spring-loaded valve and the stroke limiter. The lever bar is positioned under a first cam. The angle of the first cam adjusts the angular orientation of the lever bar with respect to the stroke limiter as well as the spring-loaded valve. The stroke limiter is biased via a stroke spring. Moreover, the stroke limiter extends downwardly, and optionally engages against a stroke limiter cam. The stroke limiter cam is optionally able to influence the stroke limiter, and is a secondary influence when compared to the angular orientation of the lever bar. In use, the variable lift valve train is able to adjust the timing and lift of the spring-loaded valve of the engine.

11 Claims, 7 Drawing Sheets

VARIABLE LIFT VALVE TRAIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of internal combustion engines, more specifically, the rocker arm pivot point.

Internal combustion engines are constantly evolving. Internal combustion engines are always being modified to improve performance or to improve efficiency. This is more important with the ever-increasing cost of gasoline and diesel fuels. One component of a gasoline engine that is in want of increased variability is the valve timing and valve lift of the internal combustion engine. There have been many attempts over the years to provide for variability in the timing of the internal combustion engine and/or to variably adjust the lift of the valve stem.

The device of the present application seeks to address this the timing as well as the lift of the valve.

SUMMARY OF THE INVENTION

The variable lift valve train includes a spring-loaded valve that is in mechanical connection with a lever bar. The lever bar is attached to a stroke limiter. The lever bar extends across the spring-loaded valve and the stroke limiter. The lever bar is positioned under a first cam. The angle of the first cam adjusts the angular orientation of the lever bar with respect to the stroke limiter as well as the spring-loaded valve. The stroke limiter is biased via a stroke spring. Moreover, the stroke limiter extends downwardly, and optionally engages against a stroke limiter cam. The stroke limiter cam is optionally able to influence the stroke limiter, and is a secondary influence when compared to the angular orientation of the lever bar. In use, the variable lift valve train is able to adjust the timing and lift of the spring-loaded valve of the engine.

An object of the invention is to provide a mechanically operated variable timing device for use with an internal combustion engine, which operates independent of the internal combustion engine and also varies the timing and lift of the applicable valve stem.

A further object of the invention is to provide a variable timing device that utilizes few components to vary timing and lift of a valve stem.

These together with additional objects, features and advantages of the variable lift valve train will be readily apparent to those of ordinary skill in the art upon reading the following detailed description of presently preferred, but nonetheless illustrative, embodiments of the variable lift valve train when taken in conjunction with the accompanying drawings.

In this respect, before explaining the current embodiments of the variable lift valve train in detail, it is to be understood that the variable lift valve train is not limited in its applications to the details of construction and arrangements of the components set forth in the following description or illustration.

Those skilled in the art will appreciate that the concept of this disclosure may be readily utilized as a basis for the design of other structures, methods, and systems for carrying out the several purposes of the variable lift valve train.

It is therefore important that the claims be regarded as including such equivalent construction insofar as they do not depart from the spirit and scope of the variable lift valve train. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
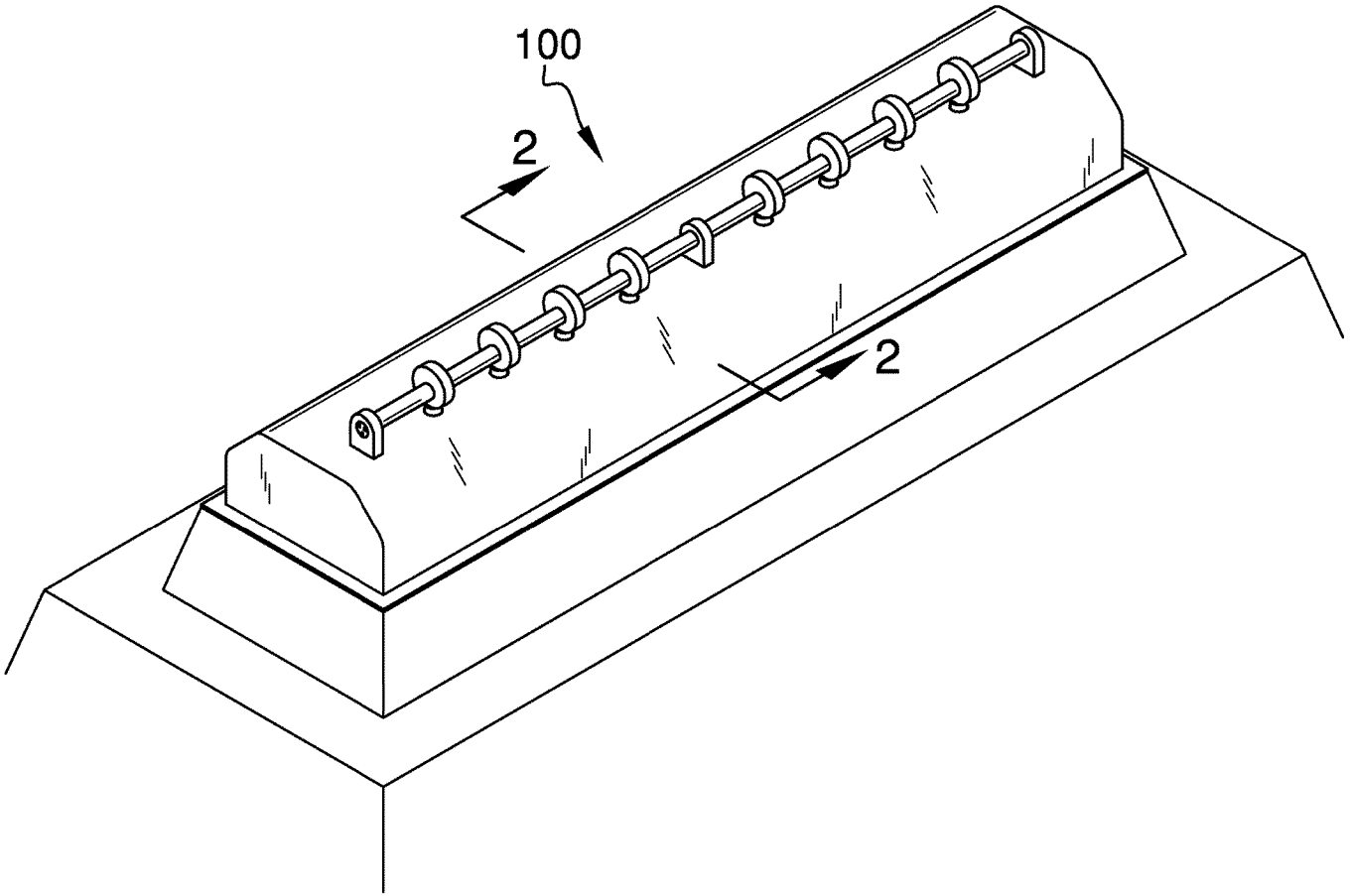
FIG. 1 illustrates an outer, perspective view of an internal combustion engine whereby the mechanically operable variable timing device is installed thereon.
Figure 2A:
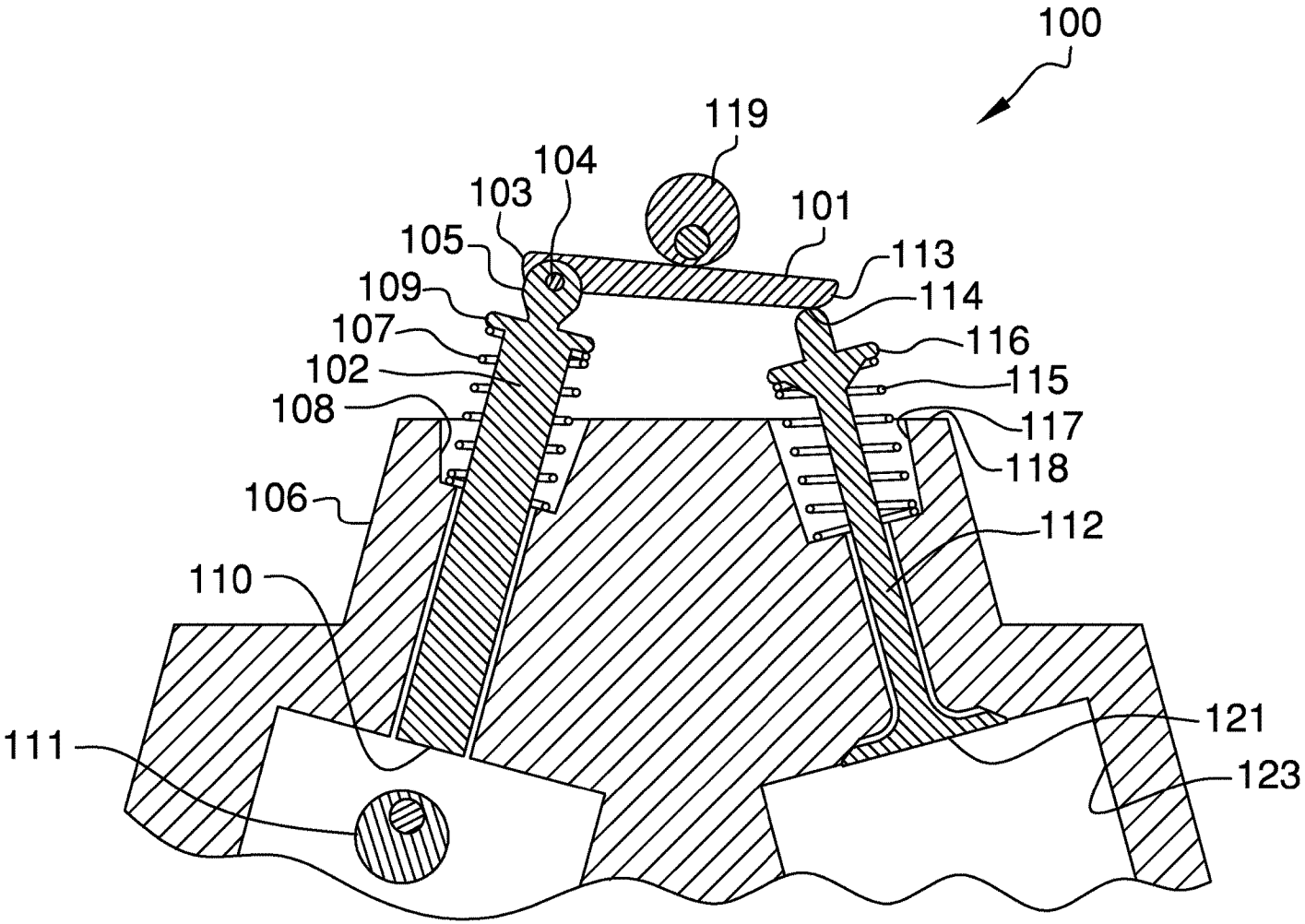
FIG. 2A illustrates a cross-sectional view along line 2-2 in FIG. 1.
Figure 2B:
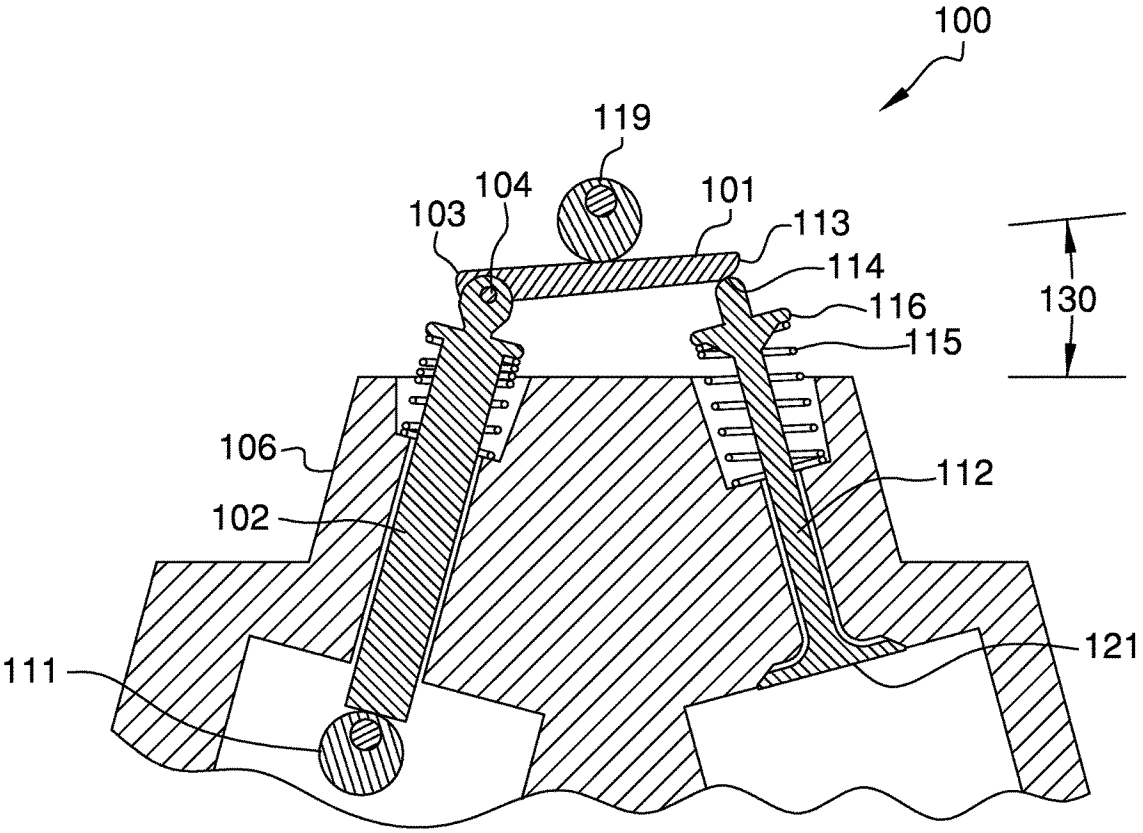
FIG. 2B illustrates a cross-sectional view along line 2-2 in FIG. 1.
Figure 2C:
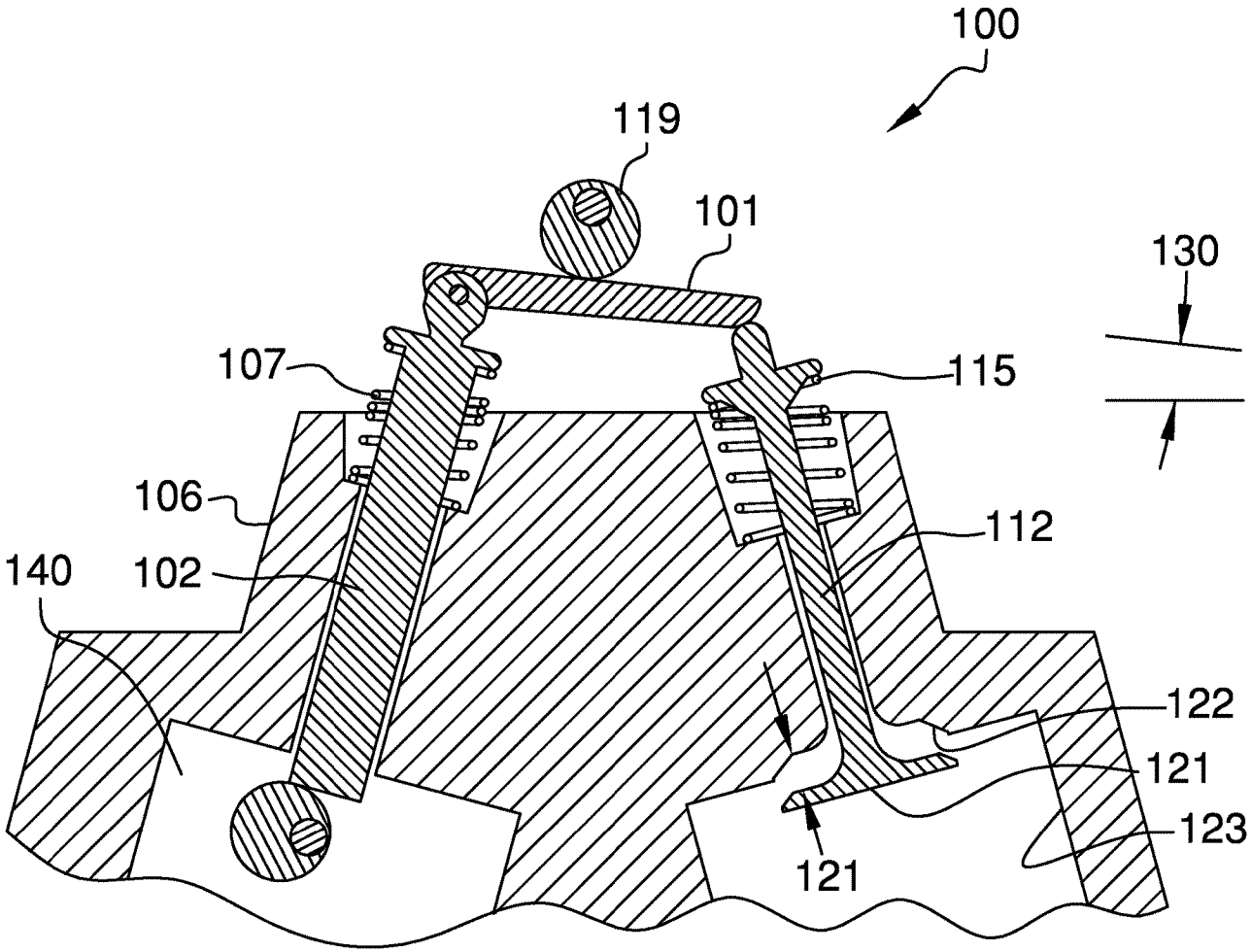
FIG. 2C illustrates a cross-sectional view along line 2-2 in FIG. 1.
Figure 2D:
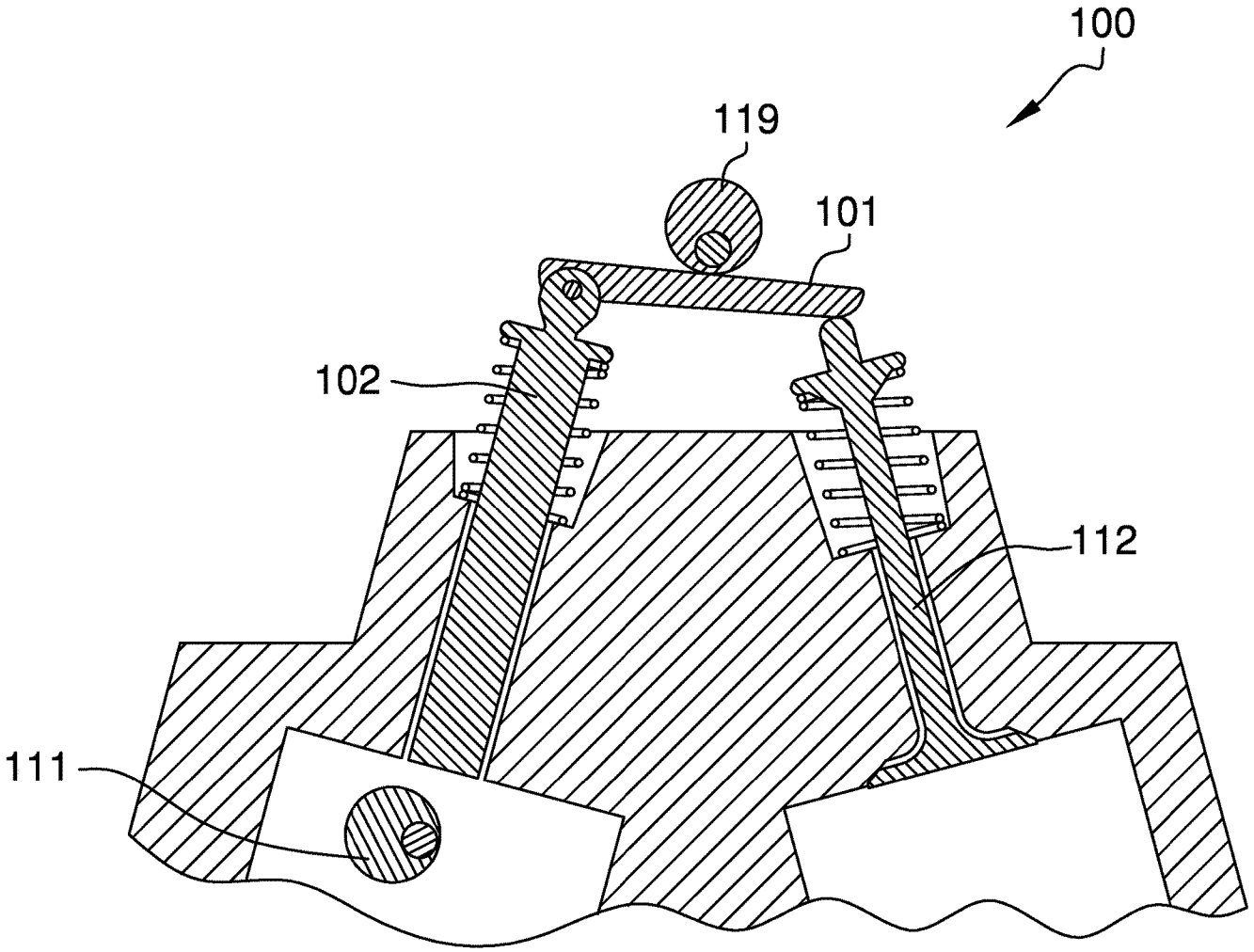
FIG. 2D illustrates a cross-sectional view along line 2-2 in FIG. 1.
Figure 2E:
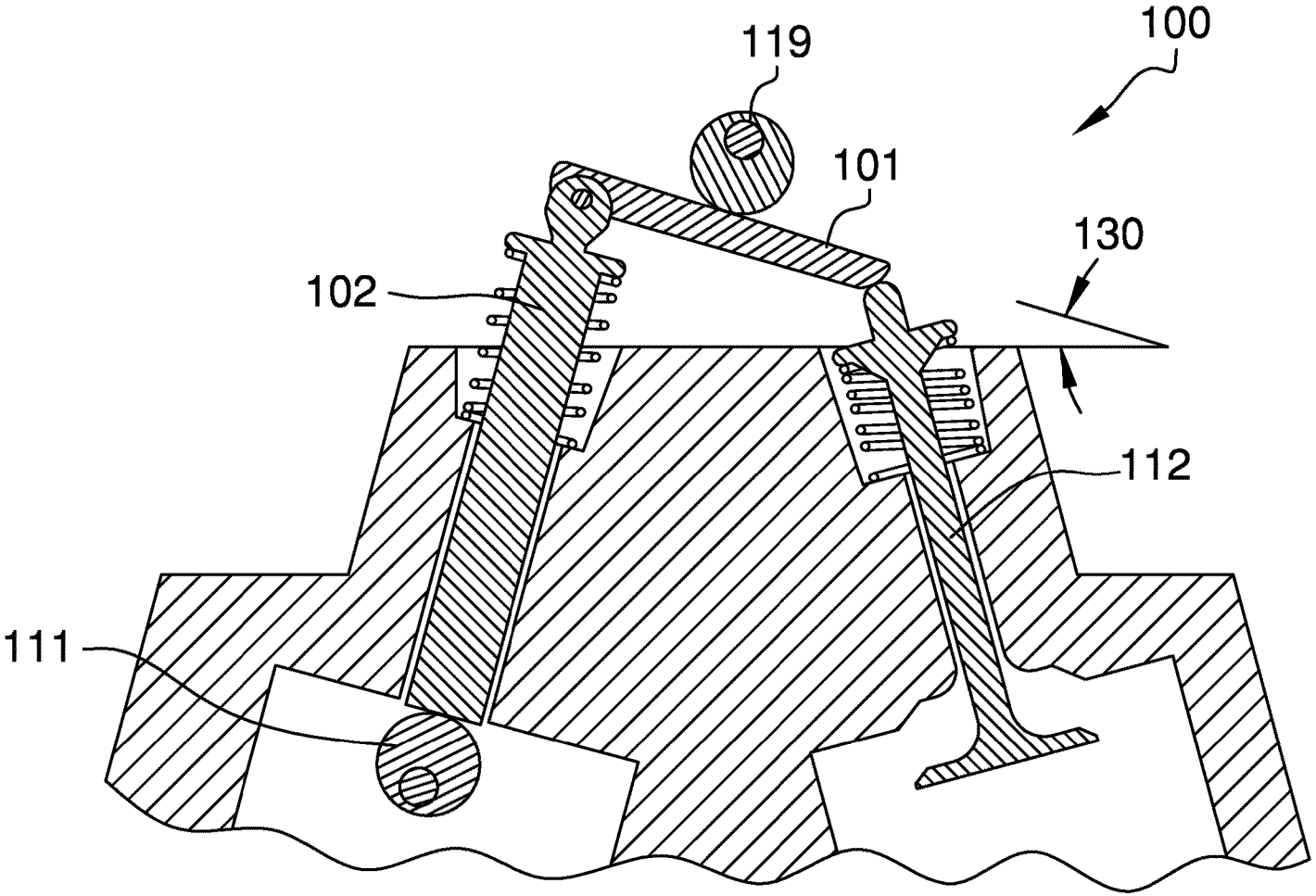
FIG. 2E illustrates a cross-sectional view along line 2-2 in FIG. 1.
Figure 2F:
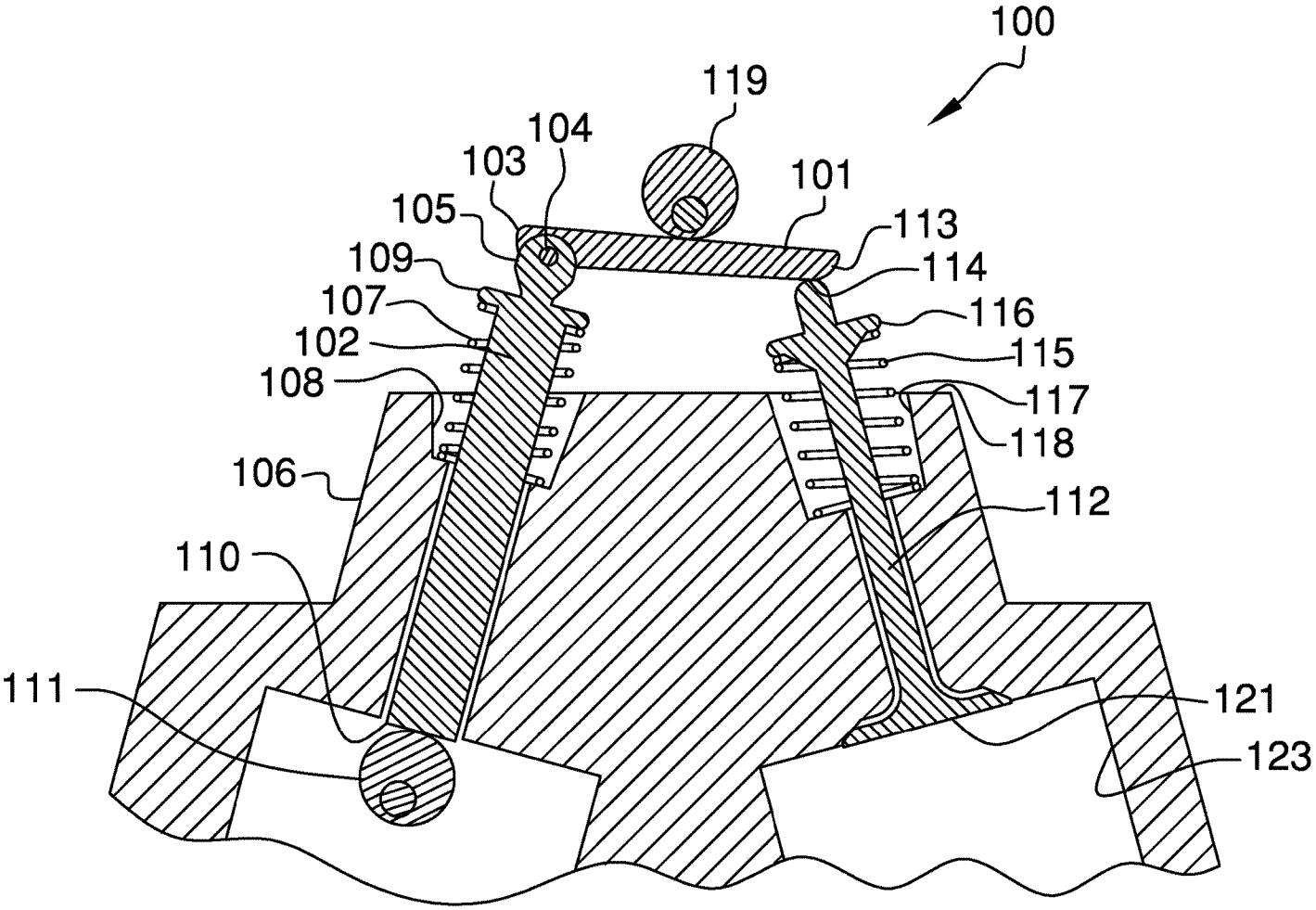
FIG. 2F illustrates a cross-sectional view along line 2-2 in FIG. 1.

Detailed reference will now be made to the preferred embodiment of the present invention, examples of which are illustrated in FIGS. 1-2F. A variable lift valve train 100 (hereinafter invention) includes a lever bar 101 that is pivotably attached to a stroke limiter 102. The lever bar 101 is further defined with a first lever end 103. A pivot pin 104 connects the lever bar 101 to the stroke limiter 102 at the first lever end 103. The stroke limiter 102 is further defined as a bar-shaped object that includes a bulbous top end 105. The pivot pin 104 attaches the lever bar 101 to the stroke limiter 102 at the bulbous top end 105.

The stroke limiter 102 is generally vertically oriented with respect to an cylinder head 106. The stroke limiter 102 is also biased upwardly via a limiter spring 107. The limiter spring 107 is positioned between a limiter cavity 108 and a limiter shoulder 109. The limiter cavity 108 is integrated into the construction of the cylinder head 106. The stroke limiter 102 is also further defined with a bottom distal end 110 that may come into contact with a stroke limiter cam 111 (see FIGS. 2A-2F).

The lever bar 101 extends from the stroke limiter 102 to a spring-loaded valve 112. The lever bar 101 is further defined with a second lever end 113 that rests atop of the spring-loaded valve 112. The second lever end 113 of the lever bar 101 has a curvature, which enables the lever bar 101 to rotate and translate atop of a top valve end 114 of the spring-loaded valve 112. The spring-loaded valve 112 includes a valve spring 115 that biases the spring-loaded valve 112 upwardly, and which is well known in the art of internal combustion engines.

The valve spring 115 is positioned between a valve collar 116 of the spring-loaded valve 112 and a valve cavity 117 located in the cylinder head 106. It shall be noted that the valve cavity 117 and the limiter cavity 108 of the cylinder head 106 are recesses formed into a top block surface 118 of the cylinder head 106.

The lever bar 101 is under the influence of an overhead cam 119. The overhead cam 119 rotates to adjust the angular orientation of the lever bar 101. It shall be noted that the valve spring 115 has a higher spring constant than the limiter spring 107. The FIGS. 2A-2F, depict the various arrangements of the spring-loaded valve 112, and the interplay of the valve spring 115, the limiter spring 107, the stroke limiter cam 111, and the overhead cam 119. The invention 100 enables the stroke and timing of the spring-loaded valve 112 to be adjusted independent of engine RPM. Traditional engines have limitations on the timing and lift of the valves in the engine in that the valves open and close in harmony with the RPM of the engine. The engine of the present invention 100 utilizes the stroke limiter cam 111, which can rotate independent of engine RPM.

It shall be further noted that a lift 120 of the spring-loaded valve 112 is defined as a distance formed between a valve head 121 and a valve opening 122 in a cylinder 123 of the cylinder head 106. The stroke limiter cam 111 is located in a limiter cavity 140 located inside of the cylinder head 106. Moreover, the limiter cavity 140 may be adjacent to the cylinder 123 of the cylinder head 106.

Referring to FIGS. 2B, 2C, and 2E, upon rotation of the overhead cam 119, the lever bar 101 pushes down on the spring-loaded valve 112 and the stroke limiter 107. Being that there is more resistance on the spring-loaded valve 112, the stroke limiter 107 will move downwardly until it encounters the stroke limiter cam 111. The position of the stroke limiter cam 111 will determine how much valve lift 120 will be diverted to the stroke limiter 107.

As the stroke limiter 102 lowers vertically, the location of the pivot pin 104 adjusts downwardly, which changes the angular orientation, alpha (a) 130 of the lever bar 101. Moreover, as the stroke limiter 102 moves downwardly, the lift 120 of the spring-loaded valve 112 decreases. It shall be noted that this example assumes that the overhead cam 117 is in the same position, which is the case for FIGS. 2B, 2C, and 2E. It shall be further noted that the overhead cam 117 rotates dependent upon engine RPM, whereas the stroke limiter cam 111 does not.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A variable lift valve train comprising:

a lever bar pivotably engaged between a spring-loaded valve and a stroke limiter;

wherein the spring-loaded valve opens and closes with respect to a cylinder of a cylinder head;

wherein the stroke limiter is able to move upwardly or downwardly in order to adjust an angular orientation of said lever bar;

wherein the lever bar is under the influence of an overhead cam, which rotates in proportion to an engine RPM of said cylinder head;

wherein adjustment of the stroke limiter adjusts a timing and lift of the spring-loaded valve with respect to the cylinder of the cylinder head;

wherein the lever bar is pivotably attached to the stroke limiter;

wherein the lever bar is further defined with a first lever end;

wherein a pivot pin connects the lever bar to the stroke limiter at the first lever end;

wherein the stroke limiter is further defined as a bar-shaped object that includes a bulbous top end;

wherein the pivot pin attaches the lever bar to the stroke limiter at the bulbous top end;

wherein the stroke limiter is generally vertically oriented with respect to the cylinder head;

wherein the stroke limiter is also biased upwardly via a limiter spring;

wherein the limiter spring is positioned between a limiter cavity and a limiter shoulder;

wherein the limiter cavity is integrated into the construction of the cylinder head;

wherein the stroke limiter is also further defined with a bottom distal end that optionally contacts with a stroke limiter cam.

2. The mechanically operable variable timing device as described in claim 1 wherein the lever bar extends from the stroke limiter to a spring-loaded valve.

3. The mechanically operable variable timing device as described in claim 2 wherein the lever bar is further defined with a second lever end that rests atop of the spring-loaded valve.

4. The mechanically operable variable timing device as described in claim 3 wherein the second lever end of the lever bar has a curvature, which enables the lever bar to rotate and translate atop of a top valve end of the spring-loaded valve.

5. The mechanically operable variable timing device as described in claim 4 wherein the spring-loaded valve includes a valve spring that biases the spring-loaded valve upwardly.

6. The mechanically operable variable timing device as described in claim 5 wherein the valve spring is positioned between a valve collar of the spring-loaded valve and a valve cavity located in the cylinder head; wherein the valve cavity and the limiter cavity of the cylinder head are recesses formed into a top block surface of the cylinder head.

7. The mechanically operable variable timing device as described in claim 6 wherein the valve spring has a higher spring constant than the limiter spring.

8. The mechanically operable variable timing device as described in claim 7 wherein the lift of the spring-loaded valve is defined as a distance formed between a valve head and a valve opening in said cylinder of the cylinder head.

9. The mechanically operable variable timing device as described in claim 8 wherein the stroke limiter cam is located in the limiter cavity located inside of the cylinder head.

10. The mechanically operable variable timing device as described in claim 9 wherein the limiter cavity is adjacent to the cylinder of the cylinder head.

11. The mechanically operable variable timing device as described in claim 10 wherein upon rotation of the overhead cam, the lever bar pushes down on the spring-loaded valve and the stroke limiter; wherein there is more resistance on the spring-loaded valve, the stroke limiter will move downwardly until it encounters the stroke limiter cam; wherein the position of the stroke limiter cam determines the amount of valve lift that is diverted to the stroke limiter.

* * * * *